United States Patent [19]

Chaplin et al.

[11] 4,053,254

[45] Oct. 11, 1977

[54] TURBINE CASE COOLING SYSTEM

[75] Inventors: Gary Francis Chaplin, Vernon; Frederick Michael Schwarz, Glastonbury, both of Conn.

[73] Assignee: United Technologies Corporation, Hartford, Conn.

[21] Appl. No.: 670,916

[22] Filed: Mar. 26, 1976

[51] Int. Cl.[2] ..... F01D 11/08; F01D 25/14

[52] U.S. Cl. ..... 415/116; 415/178

[58] Field of Search ..... 415/115, 116, 117, 178, 415/174, 136, 134

[56] References Cited

U.S. PATENT DOCUMENTS

| | | | |
|---|---|---|---|
| 3,295,823 | 1/1967 | Waugh et al. | 415/115 |
| 3,583,824 | 6/1971 | Smuland | 415/174 |
| 3,730,640 | 5/1973 | Rice et al. | 415/117 |
| 3,825,364 | 7/1974 | Halila et al. | 415/174 |

*Primary Examiner*—Carlton R. Croyle
*Assistant Examiner*—L. J. Casaregola
*Attorney, Agent, or Firm*—Robert C. Walker

[57] ABSTRACT

Apparatus for reducing the leakage of working medium gases between the rotor and stator assemblies of a gas turbine engine is disclosed. Concepts for maintaining concentric correspondence between a stator outer air seal of a gas turbine engine and the arc circumscribed by blades of the rotor assembly are discussed. Techniques for uniformly distributing the cooling air about the inner circumference of the case to control thermal distortions of the case and techniques for sealing the working medium flow are employed in one embodiment.

7 Claims, 5 Drawing Figures

FIG. 2
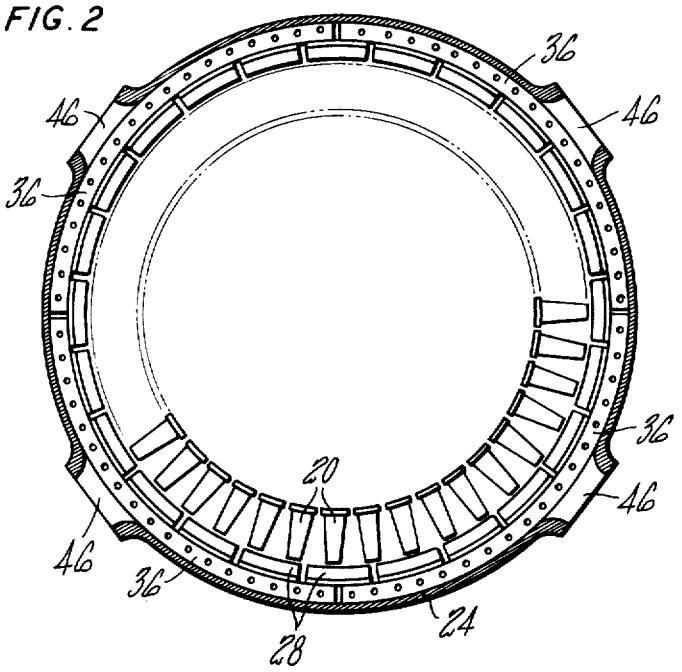
FIG. 2A
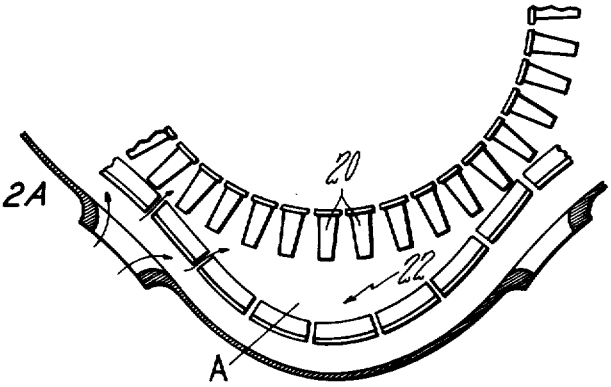
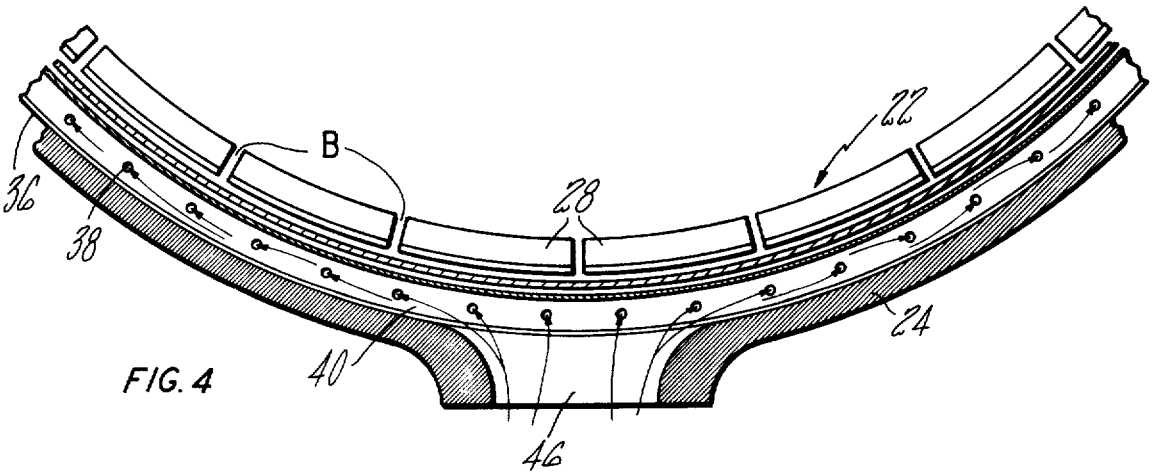
FIG. 4

TURBINE CASE COOLING SYSTEM

BACKGROUND OF THE INVENTION

1. Field of the Invention

This invention relates to gas turbine engines and more specifically to apparatus for reducing the leakage of working medium gases between the rotor and stator assemblies of a gas turbine engine.

1. Descripton of the Prior Art

Scientists and engineers within the gas turbine engine field have long recognized that substantial performance penalties are imposed upon engines by the leakage of working medium gases between the rotor and stator assemblies of an engine. They have also recognized that a substantial portion of the leakage is attributable to the radial clearance between the assemblies which is required to accommodate differential thermal expansion between the rotor and stator assemblies as the assemblies are exposed to diverse thermal environments.

At one particular interface between the rotor and stator assemblies, a turbine outer air seal surrounds and opposes the tips of the rotor blades. The outer air seal is in intimate contact with the working medium gases of the engine flow path and, accordingly, responds rapidly to variations in gas path temperature. The turbine case is located remotely from the gas path and responds much more slowly to changes in operating conditions. The outer air seal is, conventionally, segmented to prevent the buildup of mechanical stresses within the outer air seal. As the engine is accelerated during operation, the rotor assembly grows radially outward toward the outer air seal. A substantial initial clearance is provided between the seal and the blade tips to permit this radially outward growth free of destructive interference between the rotor assembly and the outer air seal. The minimum clearance between the blade tips and the outer air seal occurs during transient operating phases such as takeoff and acceleration. At equilibrium conditions, however, the clearance again increases and excessive leakage of working medium gases between the rotor and stator assemblies occurs.

The radial clearance between the rotor and stator assemblies at cruise conditions in modern engines is reduced through the incorporation of turbine case cooling systems. As the turbine case is cooled the outer air seal is forced radially inward toward the tips of the rotor blades to a position of more acceptable clearance. Although turbine case cooling holds considerable promise for improved performance, engines incorporating such systems have yet to obtain their predicted improvement.

Continuing efforts are underway to provide turbine case cooling systems which are capable of substantially improving the performance of a gas turbine engine by minimizing the clearance between the rotor assembly and the stator assembly.

SUMMARY OF THE INVENTION

A primary object of the present invention is to improve the overall performance of a gas turbine engine. Improvements in rotor blade sealing and efficient cooling air management are concurrent goals. The control of turbine case thermal ovalization through the judicious use of cooling air is sought.

According to the present invention a circumferentially extending manifold, which is disposed between the turbine case of a gas turbine engine and an outer air seal, uniformly distributes cooling air about the inner circumference of the turbine case.

A primary feature of the present invention is the circumferentially extending conduit which is formed between the manifold and the turbine case. A multiplicity of cooling air holes in the manifold distribute cooling air to circumferentially extending annuli both upstream and downstream of the manifold. In one embodiment the manifold is axially positioned by a cylindrical member which also inhibits the radial flow of cooling air between adjacent outer air seal segments into the working medium flow path. An important characteristic of the manifold is its inherent flexibility which encourages sealing contact between the manifold and the turbine case as the seal is compressed between the outer air seal and the turbine case. A manifold having a "C" shaped cross section provides this required flexibility.

A principal advantage of the present invention is a decrease in the magnitude of the case thermal ovalization. The reduced ovalization alleviates undesirable distortion of the turbine outer air seal as the seal is forced to conform to the case geometry. The radial clearance between the engine rotor and the outer air seal is reduced as the threat of destructive interference caused by case ovalization is eliminated. Engine performance is improved.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 2 is a simplified sectional view taken along the line 2—2 as shown in FIG. 1 illustrating the undistorted turbine case of the present invention;

FIG. 2A is a partial sectional view corresponding to FIG. 2 illustrating the noncorrespondence between the engine rotor and the outer air seal in an engine experiencing case thermal ovalization;

FIG. 4 is a sectional view taken along the line 4—4 as shown in FIG. 3.

DESCRIPTION OF THE PREFERRED EMBODIMENT

Figure 1:
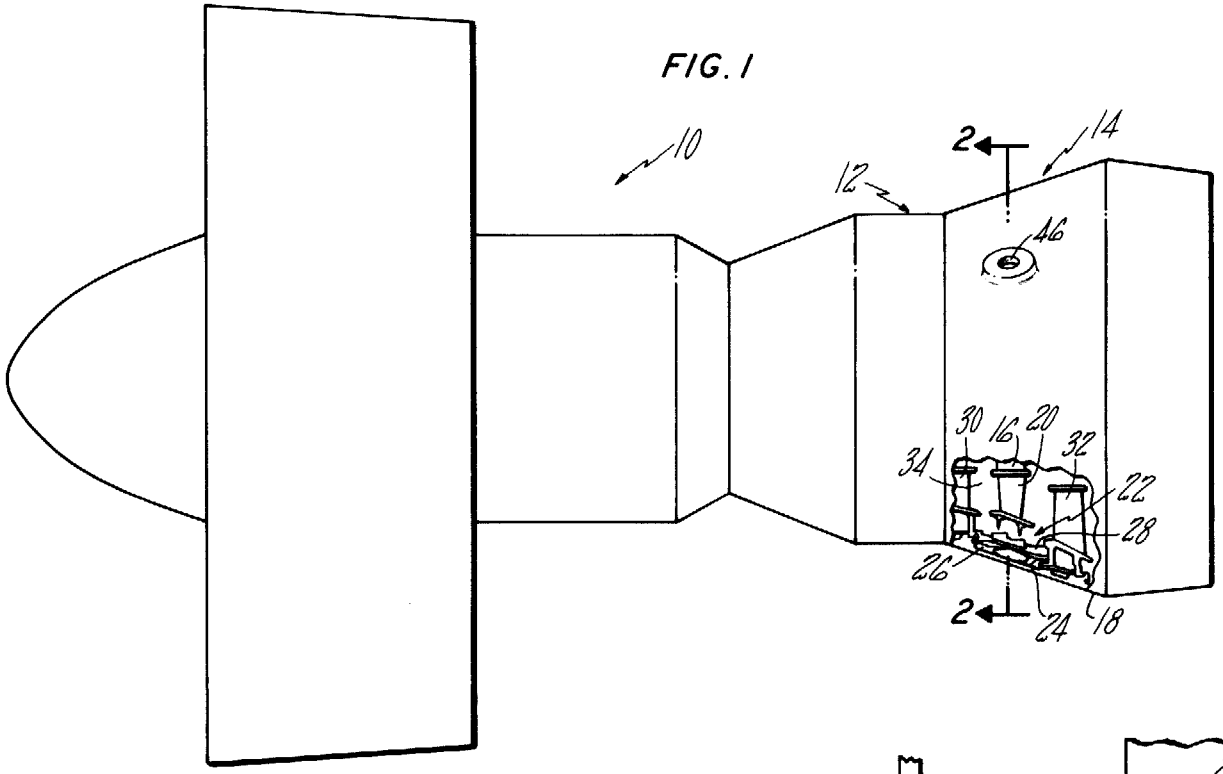
FIG. 1 is a simplified side elevation view of a turbofan, gas turbine engine showing a portion of the turbine section broken away to reveal the cooling air distribution manifold.

The gas turbine engine shown in simplified illustration in FIG. 1 has a compression section 10, a combustion section 12, and a turbine section 14. The turbine section is comprised of a rotor assembly 16 and a stator assembly 18. A plurality of rotor blades, as represented by the single blade 20, extend radially outward toward the stator assembly. An outer air seal 22 which is affixed to the turbine case 24 radially opposes the blades 20 and forms an annular chamber 26 between the seal 22 and the case 24. The outer air seal 22 is segmented, and in one embodiment includes (28 ) such segments 28. A first row of stator vanes, as represented by the single vane 30, is affixed to the case upstream of the outer air seal. A second row of stator vanes, as represented by the single vane 32, is affixed to the case downstream of the outer air seal. A flow path 34 for the working medium gases flows alternatingly through the rows of vanes and blades of the turbine section.

Figure 3:
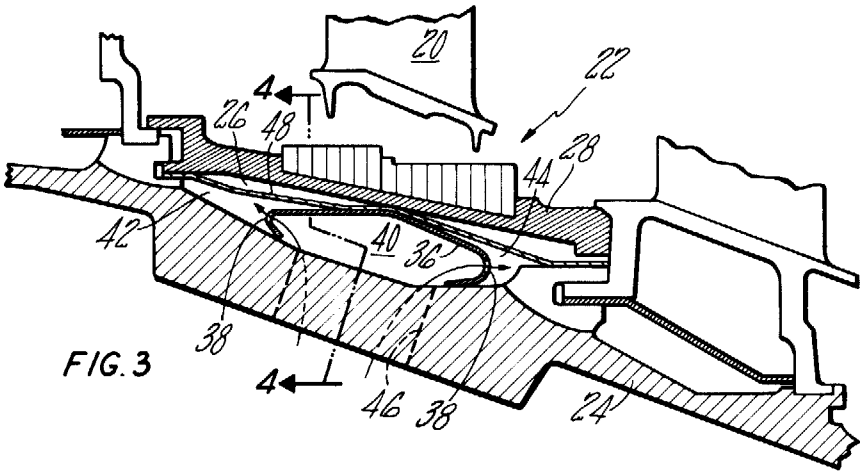
FIG. 3 is an enlarged cross section view of the air distribution manifold shown in FIG. 1.

FIG. 3 is an enlarged view showing the outer air seal 22 of FIG. 1. A circumferentially extending manifold 36, having a "C" shaped cross section, is disposed within the annular chamber 26 beneath the outer air seal 22. A multiplicity of cooling holes 38 place the center portion 40 of the manifold 36 in gas communication with an upstream annulus 42 and an downstream annulus 44. The central portion 40 of the manifold opens to a cooling air port 46. A cylindrical element 48 which spans the annular chamber 26, is attached to the manifold, and positions the manifold axially within the annular chamber. The circumferentially extending manifold 36 and the cylindrical element 48 may be segmented. One preferred embodiment incorporates four such segments as is shown in FIG. 2. In the FIG. 2 embodiment the manifold and the cylindrical elements are coextensive.

During operation of the engine, turbine case cooling air is flowable through the air ports 46 to the central portion 40 of the manifold 44. The air is deflected circumferentially about the engine within the manifold and directed uniformly to the upstream annulus 42 and to the downstream annulus 44 through the cooling holes 38. The air flows adjacent to the turbine case in the generally upstream direction from the upstream annulus 42 and in the generally downstream direction from the downstream annulus 44.

The uniform distribution of the cooling air enables case cooling without inducing severe thermal gradients between the air port locations. Corresponding apparatus not incorporating the distribution manifold of the present invention is illustrated in FIG. 2A. As is shown in exagerrated illustration, the turbine case 24 is cooled dramatically in the region adjacent the air ports 46, leaving the region between the ports essentially uncooled. Differential thermal expansion between the cooled and uncooled regions causes thermal deformation of the turbine case. This thermal deformation is commonly referred to in the industry as "case thermal ovalization" and, as can be seen, severely alters the geometric corrspondence between the outer air seal 22 and the tips of the blades 20. Substantial leakage flow of working medium gases between the blades and the seal occurs in the region A. Overall engine performance is detrimentally effected.

In the contrasting apparatus of FIG. 2, which does incorporate the air distribution manifold, the turbine case is uniformly cooled and remains undistorted. The undistorted case carries the seal segments 28 in end to end relationship forming an outer air seal which is concentric with the arc circumscribed by the tips of the blades 20 during operartion of the engine.

The manifold 36 in one embodiment has a "C" shaped cross section and is comprised in one embodiment of a sheet metal material. Similarly effective embodiments incorporate manifolds having "E" shaped cross sections or other correspondingly flexible configurations. The manifold is wedged between the outer air seal 22 and the case 24 so as to initiate sealing contact between the manifold and the case. Furthermore, as the central portion 40 of the manifold is pressurized with cooling air, the seal tends to deform in a manner increasing the sealing force upon the case. In one embodiment a sheet metal material thickness of approximately 0.012 of an inch has proved to be a particularly effective embodiment although similarly flexible material thickness can be inspected to produce corresponding results under varied pressure conditions.

As is shown in FIG. 3, a cylindrical element 48 may be affixed to the manifold 36. The cylidrical element, when employed, spans the axial length of the chamber 26 and positions the manifold axially therein. The cylindrical member 48 performs the additional function of sealing the gaps B between adjacent outer air seal segments 28 as is viewable in FIG. 4.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. For a gas turbine engine, a turbine stator assembly comprising:
   - a turbine case having a plurality of cooling air ports circumferentially spaced about the outer periphery thereof;
   - a first row of stator vanes extending inwardly from the case upstream of the cooling air ports;
   - a second row of stator vanes extending inwardly from the case downstream of the cooling air ports;
   - an outer air seal which is positioned between said first and second rows of stator vanes and which radially opposes the blades of the engine rotor assembly, said outer air seal and said turbine case cooperatively forming an annular chamber therebetween which is in gas communication with the cooling air ports;
   - a manifold which is disposed within the annular chamber forming a cooling air distribution conduit for flowing cooling air from said ports circumferentially about the engine, wherein said manifold has a multiplicity of cooling holes through which cooling air is uniformly flowable during operation of the engine; and
   - a cylindrical element which is attached to said manifold and spans the annular chamber to position the manifold axially within the chamber.

2. The invention according to claim 1 wherein said manifold is wedged between the outer air seal and the turbine case to maintain sealing contact with the turbine case.

3. The invention according to claim 2 wherein said manifold has a "C" shaped cross section and faces radially outward toward the turbine case.

4. The invention according to claim 3 wherein said "C" shaped element is fabricated of flexible sheet metal.

5. The invention according to claim 4 wherein said sheet metal has a thickness of approximately 0.012 of an inch.

6. The invention according to claim 2 wherein said manifold has an "E" shaped cross section and faces radially outward toward the turbine case.

7. The invention according to claim 1 wherein said manifold is comprised of a plurality of segments which conjunctively extend about the entire circumference of the engine.

* * * * *